US007581293B1

(12) United States Patent
Allen

(10) Patent No.: US 7,581,293 B1
(45) Date of Patent: Sep. 1, 2009

(54) GEL LINERS

(76) Inventor: Jennifer R. Allen, 639 Smallwood Rd., Dayton, OH (US) 45427

( * ) Notice: Subject to any disclaimer, the term of this patent is extended or adjusted under 35 U.S.C. 154(b) by 71 days.

(21) Appl. No.: 12/030,618

(22) Filed: Feb. 13, 2008

(51) Int. Cl.
*A61G 17/00* (2006.01)

(52) U.S. Cl. ..... 27/19

(58) Field of Classification Search ..... 27/19; D99/10; 220/495.01, 908.1; 604/368, 385.01, 604/385.03, 386–387, 389, 391
See application file for complete search history.

(56) References Cited

U.S. PATENT DOCUMENTS 4,520,043 A 5/1985 Davidian
4,827,581 A 5/1989 Davidian
4,951,367 A 8/1990 Wolfe
D313,526 S 1/1991 Rankin et al.
5,444,900 A * 8/1995 Shawhan et al. ..... 27/19
5,615,464 A 4/1997 Rojdev
5,666,705 A * 9/1997 Semon ..... 27/19
5,771,550 A 6/1998 Laphan et al.

* cited by examiner

*Primary Examiner*—William L. Miller
(74) *Attorney, Agent, or Firm*—Kyle Fletcher

(57) ABSTRACT

The invention is a casket liner comprising a top layer, a middle layer, and a bottom layer containing a plurality of adhesive strips along the bottom surface of the bottom layer. The top layer consists of a dry weave. The middle layer contains the reacting chemicals. The invention includes flaps along the perimeter, each of which contains the same three layers mentioned above.

8 Claims, 2 Drawing Sheets

GEL LINERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention generally relates to a casket liner, and more specifically relates to a casket liner wherein any fluid absorbed by said liner is transformed into a gel.

B. Discussion of the Prior Art

The Laphan et al. Patent (U.S. Pat. No. 5,771,550) discloses a method of constructing a liquid impervious casket liner. However, the casket liner of the Laphan Patent is directed to preventing the introduction of liquids into the casket from outside, as opposed to a casket liner that absorbs liquids derived from within the casket, and converting said absorbed liquid into a gel.

The Rojdev Patent (U.S. Pat. No. 5,615,464) discloses a liquid retaining system for a casket shell. However, the liquid retaining system of the Rojdev Patent does not transform absorbed liquids into a gel.

The Davidian Patent (U.S. Pat. No. 4,827,581) discloses a metal casket having an impervious plastisol liner. However, the plastisol liner of the Davidian Patent is designed to coat the metal surface of the casket in order to prevent corrosion of the interior surface of the casket associated with organic acids whereas the present invention seeks to absorb liquids that accumulate from within the casket, and to transform said liquids into a gel.

The Wolfe Patent (U.S. Pat. No. 4,951,367) discloses another liner tray for a casket. However, the liner tray of the Wolfe Patent consists of a non-corrosive liner that simply collects the organic acids of the deceased and prevents said organic acids from corroding the surface of the casket, as opposed to a liner that absorbs the organic acids and transforms them into a gel.

The Davidian Patent (U.S. Pat. No. 4,520,043) discloses a method of preventing corrosion in a casket in which the casket is coated with a composition comprising sodium bicarbonate. However, the coating of the Davidian Patent is designed to prevent the corrosion of a casket, but it does not transform the accumulated liquids into a gel nor does it contain an adhesive backing.

The Rankin et al. Patent (U.S. Pat. No. Des. 313,526) illustrates a design for an infant seat liner, which is not directed to a casket nor discloses a means of transforming accumulated liquids into a gel.

BRIEF SUMMARY OF THE INVENTION

The invention is a casket liner comprising a top layer, a middle layer, and a bottom layer containing a plurality of adhesive strips along the bottom surface of the bottom layer. The top layer consists of a dry weave. The middle layer contains the reacting chemicals. The invention includes flaps along the perimeter, each of which contains the same three layers mentioned above.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
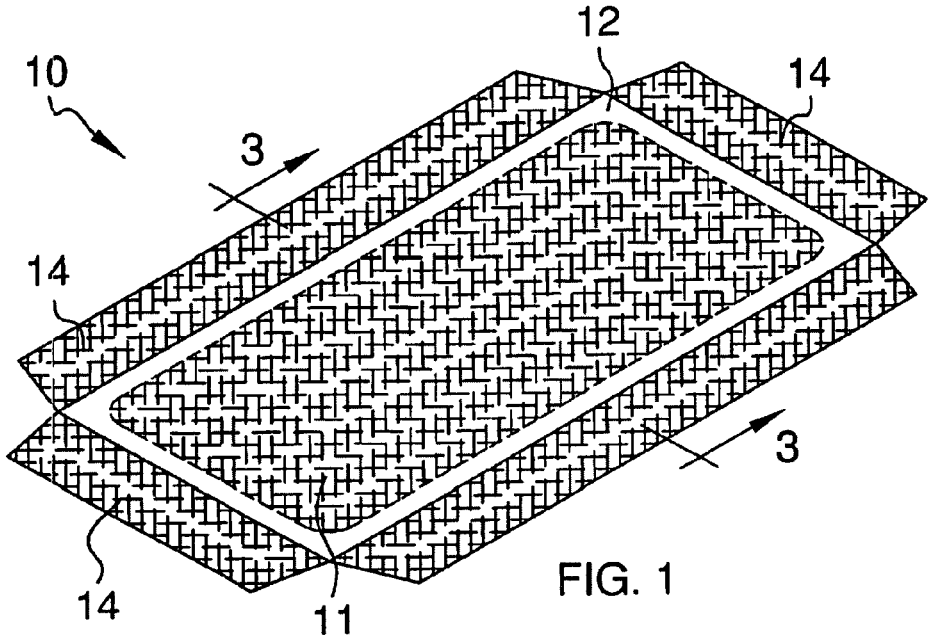
FIG. 1 illustrates a top, isometric rendering of the invention.
Figure 2:
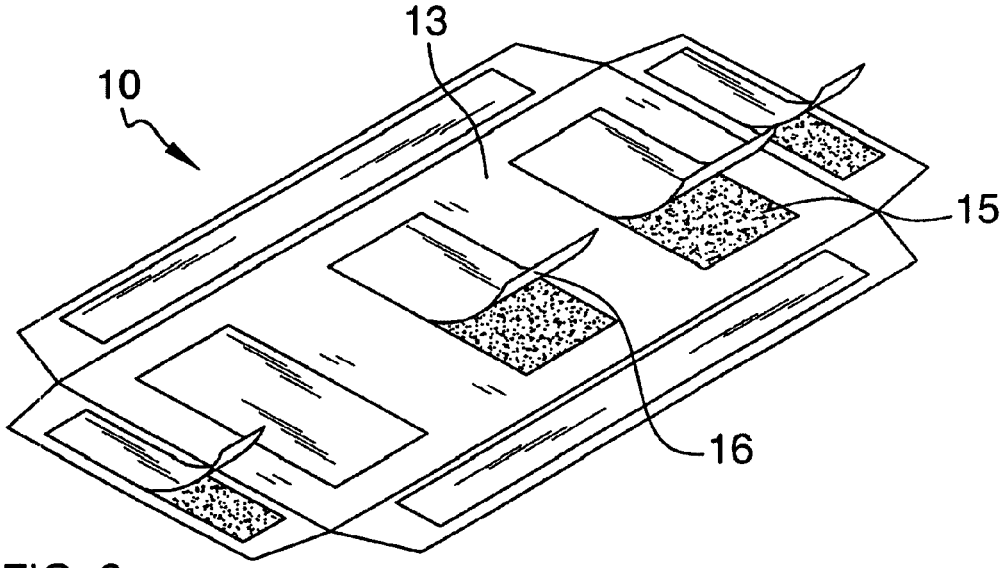
FIG. 2 illustrates a bottom, isometric rendering of the invention.
Figure 3:
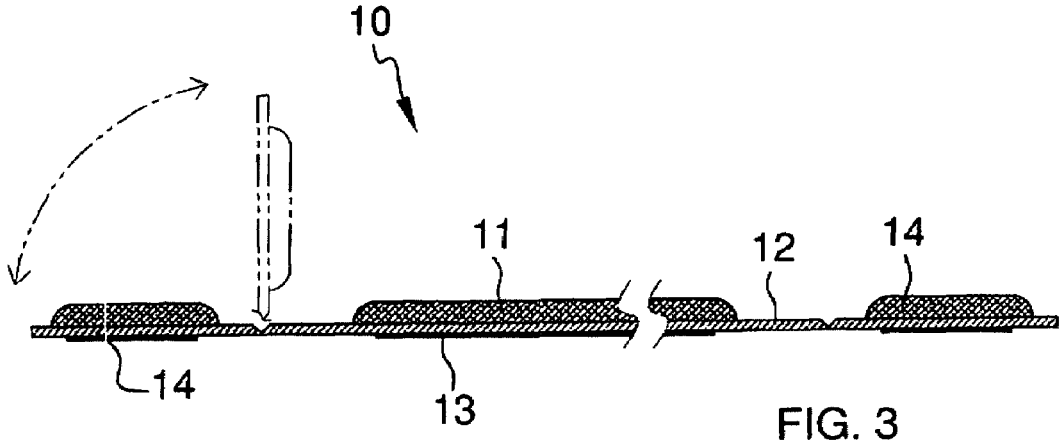
FIG. 3 illustrates a cross-sectional view of the invention along line 3-3 in FIG. 1.
Figure 4:
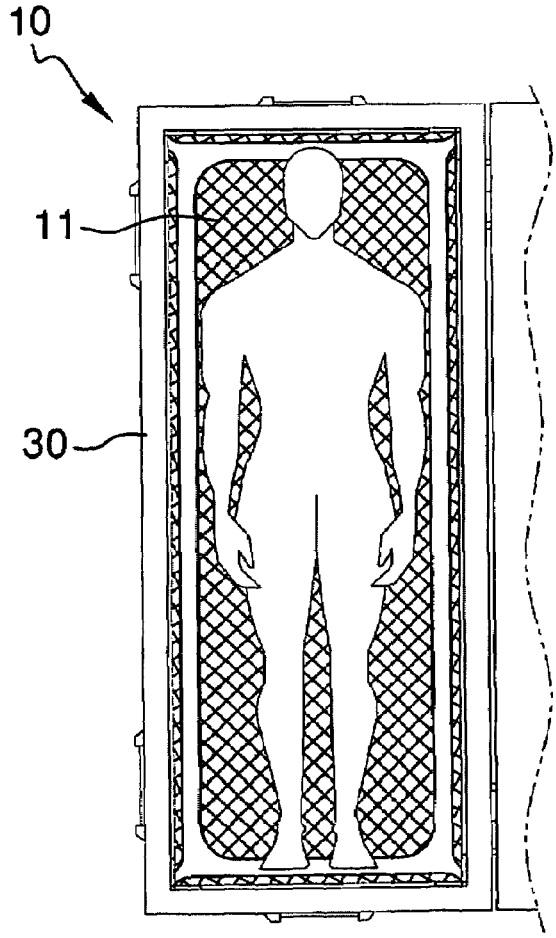
FIG. 4 illustrates a top view of the invention in use with a deceased individual.

Detailed reference will now be made to the preferred embodiments of the present invention, examples of which are illustrated in FIGS. 1-4. A casket liner 10 (hereinafter invention) consists of a dry weave top layer 11, a middle layer 12, and a bottom layer 13. The top layer 11 is made of an absorbent material comprising polyester, cotton, or paper.

The middle layer 12 contains a poly (sodium acrylate) homopolymer or sodium salt containing polyacrylic acid. The middle layer has a plurality of flaps 14 along the perimeter of the invention 10. The flaps 14 are designed to expand coverage to the bottom portion of each side of a casket 30. The middle layer 12 is composed of a porous fabric comprising polyester, cotton, or paper.

The poly (sodium acrylate) homopolymer or sodium salt containing polyacrylic acid of the middle layer 12 is designed to interact with fluids that are associated with a decomposing human body that may or may not contain an embalming fluid, such as formaldehyde. The use of formaldehyde as an embalming fluid generates a formic acid that is corrosive to the interior surface of the casket. More importantly, the use of formaldehyde along with other embalming fluids may contaminate the surrounding soil. In addition to formaldehyde, the decomposition of a human body generates organic acids that are also corrosive when they contact the side of the casket. The invention 10 seeks to overcome the corrosive effects of formic and organic acids, by using the middle layer 12, which will absorb and transform the organic or formic acids into a gel (not depicted). The resulting gel will be contained within the middle layer 12.

The top surface of the middle layer 12 is attached to the bottom surface of the top layer 11 by an attaching means comprising adhesive or sewing.

The bottom layer 13 contains a plurality of adhesive strips 15. The adhesive strips 15 are designed to hold the invention 10 in a stationary position with respect to the bottom and sides of the casket 30. The bottom layer 13 is composed of a non-pourous material comprising a durable plastic, cotton, paper, wood, metal, or rubber.

The top surface of the bottom layer 13 is attached to the bottom surface of the middle layer 12 by an attaching means comprising adhesive or sewing.

The adhesive strips 15 would come prepackaged with a removable strip 16 that would prevent premature exposure of the adhesives contained on the adhesive strips 15.

The invention 10 would have an overall length of roughly 25 to 100 inches, and a range of width of 10 to 60 inches.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A casket liner for placement within a casket comprising:

(a) a top layer;

wherein the top layer is composed of a porous fabric that has a highly-absorbent dry weave;

(b) a middle layer; and wherein the middle layer contains a reactant within a porous fabric such that the middle layer absorbs and transforms organic and formic acids into a gel;

wherein the top surface of the middle layer is attached to the bottom surface of the top layer by an upper attaching means;

(c) a bottom layer;

wherein the bottom layer is comprised of a non-porous material;

wherein the bottom layer contains a plurality of adhesive strips along the bottom surface of the non-porous material for securement to the casket;

wherein the top surface of the bottom layer is attached to the bottom surface of the middle layer by a lower attaching means.

2. The casket liner as described in claim 1 wherein the reactant is sodium acrylate in a crystalline state.

3. The casket liner as described in claim 1 wherein the reactant is polyacylic acid in a crystalline state.

4. The casket liner as described in claim 1 wherein the a porous fabric of the top layer is made of a material comprising cotton, polyester, or paper.

5. The casket liner as described in claim 1 wherein the porous fabric of the middle layer is made of a material comprising cotton, polyester, or paper.

6. The casket liner as described in claim 1 wherein the non-porous material of the bottom layer is made of a material comprising durable plastic, cotton, paper, wood, metal, or rubber.

7. The casket liner as described in claim 1 wherein the upper attaching means comprises adhesive or sewing.

8. The casket liner as described in claim 1 wherein the lower attaching means comprises adhesive or sewing.

* * * * *